US006448894B1

(12) United States Patent
Desai

(10) Patent No.: US 6,448,894 B1
(45) Date of Patent: Sep. 10, 2002

(54) PASSIVE ACTUATION OF HOME SECURITY SYSTEM

(75) Inventor: Tejas Desai, Sterling Heights, MI (US)

(73) Assignee: Siemens Automotive Corporation, Auburn Hills, MI (US)

( * ) Notice: Subject to any disclaimer, the term of this patent is extended or adjusted under 35 U.S.C. 154(b) by 79 days.

(21) Appl. No.: 09/660,716

(22) Filed: Sep. 13, 2000

Related U.S. Application Data

(60) Provisional application No. 60/157,175, filed on Sep. 30, 1999.

(51) Int. Cl.[7] ..... G08B 26/00

(52) U.S. Cl. ..... 340/505; 340/539; 340/825.31

(58) Field of Search ..... 340/933, 502, 340/505, 539, 825.3, 825.31, 825.34, 5.61, 5.62

(56) References Cited

U.S. PATENT DOCUMENTS 3,891,980 A * 6/1975 Lewis et al. ..... 340/505
6,081,203 A * 6/2000 Fitzgibbon ..... 340/825.72

* cited by examiner

*Primary Examiner*—Daryl Pope

(57) ABSTRACT

A passive actuation of a home security system incorporates a sensor for sensing movement of a vehicle approaching the home security system. When such movement is detected, a signal is sent to a control for the home security system. The home security system generates a challenge response which is received by a transmitter/receiver associated with the vehicle. The vehicle transmitter/receiver receives the challenge response and sends its response to the challenging control. The vehicle response is received by the control for the home security system and compared to an expected response. If the two match, then the home security system is actuated. The system may be utilized on garage door openers, fences, home locks, etc.

10 Claims, 1 Drawing Sheet

Fig-1
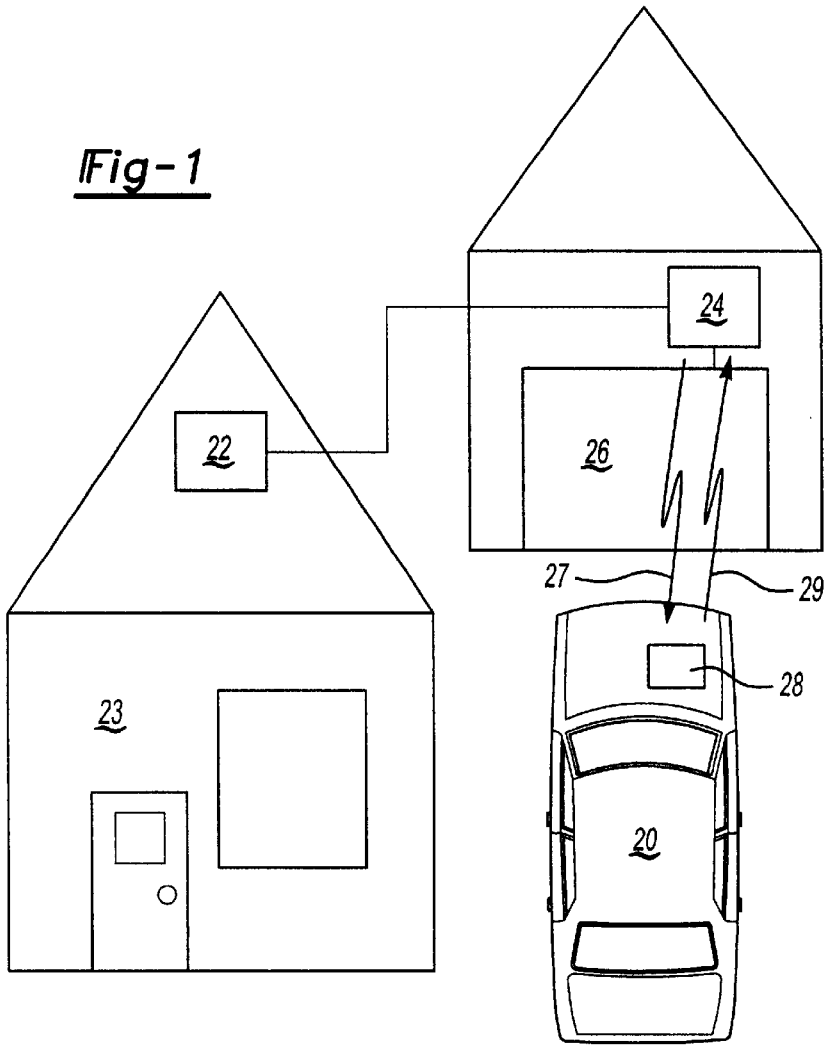
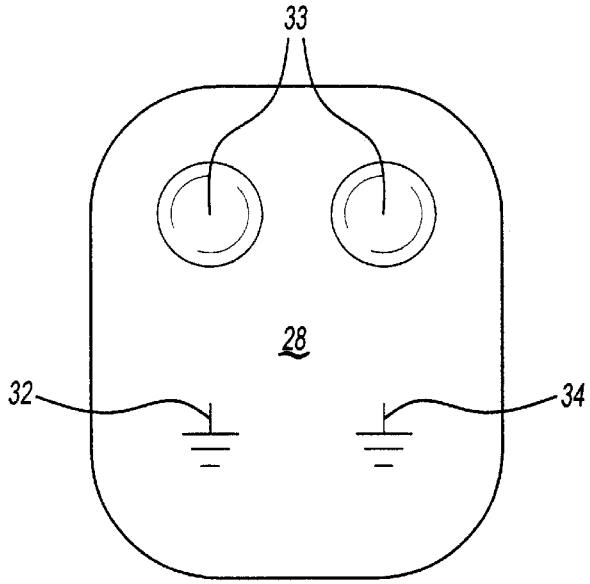
Fig-2

PASSIVE ACTUATION OF HOME SECURITY SYSTEM

This application claims priority to provisional application Ser. No. 60/157,175, filed on Sep. 30, 1999.

BACKGROUND OF THE INVENTION

This application relates to a passive activation of a home security system. Vehicles and homes are becoming more electrically complex. Vehicles are now provided with a number of electronic security systems such as door locks, trunk locks, etc. These security systems are typically actuated by a remote signaling device known as a key fob signaling device. Key fob signaling devices are also becoming incorporated into the vehicle keys themselves. Such combinations are provided with the ability to transmit code to other security devices when in the vehicle. As one major example of this function is the use of an immobilizer system which communicates with the key to determine whether a proper key is in the ignition.

The vehicle keys and/or key fobs are typically provided with an RF link for transmitting code and unlocking vehicle security systems remotely. Further, they are often provided with an LF link for actuating or allowing actuation of a vehicle ignition.

Vehicles are often also provided with a garage door opener. Garage door openers are actuated from the interior of the vehicle and send a code to the garage door for opening the garage door as the vehicle approaches. Such actuation are also known for other home security systems such as home door locks, fences, etc.

It has been proposed to have passive entry systems for home security functions, such as garage doors. One example utilizes a magnetic sensor on a vehicle, which sends a signal from a vehicle when magnetic members in the driveway are passed over by the vehicle. These systems act to passively actuate a signal to open the home security system (garage door). These systems are somewhat deficient in that they require modification to the home itself, and further could actuate the transmission of a signal by any vehicle passing over the magnetic members which is provided with the particular security system. Thus, it would be desirable to develop a system which only actuates the transmission of a signal if the appropriate vehicle is approaching the home security system.

SUMMARY OF THE INVENTION

In the disclosed embodiment of this invention a sensor senses the presence of a vehicle approaching a home security system. The sensor then generates a challenge signal from the home security system which is directed at the vehicle. The challenge generates a response from the vehicle signaling device, and that response is compared to an expected response. If the response corresponds to the expected response, then the home security system is actuated.

The technology for providing the coded information associated with each vehicle is known and forms no portion of this invention. A worker in this art would be well aware of a number of encoding options and algorithms for encoding signals such as garage door opener signals.

In a preferred embodiment of this invention, the signaling device for sending the passive signal will be incorporated into the key or key fob in the vehicle. Co-pending patent application Ser. No. 09/661,351 filed on Sep. 14, 2000 and entitled "Garage Door Opener Signal Incorporated Into Vehicle Key/Fob Combination" and invented by the inventor of this application discloses several benefits for incorporating the home security actuation function into the key or key fob. One additional function that is directed to this application is that the key/key fob would be a so called "combi-key". Such systems include an RF transmitter, and also an LF receiver and transmitter for use with the immobilizer system. In such a case, no modification to the key/key fob is necessary. Instead, the challenge and corresponding response could be sent as an LF signal as the vehicle approaches the home security system. This is also beneficial in that the signal will not travel an undue distance, which might jeopardize the security of the signal.

These and other features of the present invention can be best understood from the following specification and drawings, the following of which is a brief description.

BRIEF DESCRIPTION OF THE DRAWINGS

FIG. 1 schematically shows a passive home security system actuation.

FIG. 2 is a schematic view of a key/key fob incorporating the present invention.

DETAILED DESCRIPTION OF A PREFERRED EMBODIMENT

FIG. 1 shows a vehicle 20 passing by sensor 22 associated with the home 23. The sensor 22 may be an infrared sensor having associated controls such as are commonly utilized to actuate exterior lights when a passer-by passes a home. The sensor 22 communicates with a control 24 for a home security system, shown here as garage door opener 26. When the infrared sensor 22 senses the presence of the vehicle 20, that is as the vehicle approaches the garage door, the sensor generates a challenge signal 27 from the control 24. This is preferably an LF signal, although other signals may be utilized. This challenge signal is received by a transmitter 28 on the vehicle 20. The transmitter 28 sends a response 29 back to the control. Any encoding technology may be incorporated into the challenge 27 and response 29. As an example, the challenge may incorporate a code which is modified by the response in a certain fashion. The control 24 can then check the response 29 to determine whether the proper modification has been made. Other types of encoding are known, and any such encoding can be utilized. It is the passive generation of the challenge and response which is inventive here.

By passively generating a challenge and response, only the proper vehicle is allowed to actuate the home security system. Moreover, no modification to the home itself, such as incorporation of magnets in the driveways, etc. is necessary.

FIG. 2 shows a preferred application for the transmitter 28. Transmitter 28 is shown here as a combined key fob and key. An RF transmitter 32 is shown which corresponds to switches 33 such as door lock, etc. A transmitter and receiver 34 is also shown which is preferably an LF transmitter/receiver, and which is utilized to communicate with an immobilizer system on the vehicle ignition. The challenge 27 is preferably sent on an LF frequency, and the response 29 is also on an LF frequency.

Since key/key fob combinations incorporating both RF and LF transmitter and an LF receiver are known, no major modification of the key is necessary. The main distinction that the key/key fob transmitter 28 must be programmed to have the appropriate algorithms for modifying and preparing the appropriate response 29. Any method of teaching a signal to an electronic device may be utilized. Proposed methods are disclosed in the co-pending patent application Ser. No. 09/661,351 (which is filed on even date herewith) entitled "Incorporation of Home Security Function into Key Fob" and which names the inventor of this application as its sole inventor.

Although a preferred embodiment of this invention has been disclosed, a worker in this art would recognize that modifications of this invention would come within the scope of this invention. For that reason, the following claims should be studied to determine the true scope and content of this invention.

What is claimed is:

1. A method of passively activating a vehicle security system comprising:

1) providing a sensor for sensing a motor vehicle approaching a home security system, and providing a control for a home security system capable of transmitting and receiving signals, said sensor communicating with said home security system control and providing a receiver and transmitter associated with a vehicle;

2) sensing the approach of a motor vehicle with said sensor, and communicating a signal indicative of an approaching motor vehicle to said home security system control;

3) generating a challenge from said home security system control, and said challenge being received at said vehicle receiver;

4) generating a response to said challenge from said vehicle transmitter, said response being received from said home security system control; and 5) comparing said received response to an expected response and actuating said home security system if said received response corresponds to said expected response, said home security system being a garage door opener.

2. A method as set forth in claim 1, wherein said vehicle receiver is incorporated into a key.

3. A method as set forth in claim 1, wherein said sensor is an infrared sensor sensing the approaching vehicle.

4. A method as set forth in claim 1, wherein said home security system is a garage door opener.

5. A method as set forth in claim 1, wherein said challenge and said response are sent on an LF band.

6. A system for passively actuating a home security system comprising:

a home security system being a garage door opener and incorporating a control for transmitting and receiving signals to and from a motor vehicle receiver/transmitter, and for comparing a received response from a motor vehicle to an expected response;

a sensor for sensing an approaching motor vehicle, said sensor sending a signal to said control for said home security system to generate a challenge signal; and a transmitter/receiver associated with a motor vehicle, said transmitter/receiver associated with said motor vehicle receiving said challenge from said home security system control, and generating and transmitting a response.

7. A system as set forth in claim 6, wherein said vehicle transmitter/receiver is incorporated into a key.

8. A system as set forth in claim 7, wherein said vehicle transmitter/receiver is incorporated into an LF transmitter/receiver in said key.

9. A system as set forth in claim 6, wherein said home security system is a garage door opener.

10. A system as set forth in claim 6, wherein said sensor is an infrared sensor or sensing approaching movement.

* * * * *